US010562298B2

(12) United States Patent
Muhl

(10) Patent No.: US 10,562,298 B2
(45) Date of Patent: Feb. 18, 2020

(54) APPARATUS FOR PROCESSING AND PRINTING ITEMS

(71) Applicant: Francotyp-Postalia GmbH, Berlin (DE)

(72) Inventor: Wolfgang Muhl, Hohen Neuendorf (DE)

(73) Assignee: Francotyp-Postalia GmbH, Berlin (DE)

( * ) Notice: Subject to any disclaimer, the term of this patent is extended or adjusted under 35 U.S.C. 154(b) by 0 days.

(21) Appl. No.: 16/145,668

(22) Filed: Sep. 28, 2018

(65) Prior Publication Data

US 2019/0118562 A1 Apr. 25, 2019

(30) Foreign Application Priority Data

Oct. 24, 2017 (DE) ..... 20 2017 106 430 U

(51) Int. Cl.

| | |
|---|---|
| ***B41J 2/045*** | (2006.01) |
| ***B41J 2/165*** | (2006.01) |
| ***B41J 2/175*** | (2006.01) |
| ***G07B 17/00*** | (2006.01) |
| ***B41J 2/145*** | (2006.01) |
| ***B41J 25/00*** | (2006.01) |

(52) U.S. Cl.

CPC ..... *B41J 2/04556* (2013.01); *B41J 2/04586* (2013.01); *B41J 2/145* (2013.01); *B41J 2/16508* (2013.01); *B41J 2/17523* (2013.01); *B41J 25/006* (2013.01); *G07B 17/00508* (2013.01); *G07B 2017/00532* (2013.01)

(58) Field of Classification Search

CPC .... B41J 2/04556; B41J 2/04586; B41J 2/145; B41J 2/16508; B41J 2/17523; B41J 25/006; B41J 2/16517; B41J 2/1752; B41J 13/12; B41J 2/175; B41J 25/001; G07B 17/00508; G07B 2017/00532; G07B 17/00193

See application file for complete search history.

(56) References Cited

U.S. PATENT DOCUMENTS

| | | | | |
|---|---|---|---|---|
| 6,106,095 | A * | 8/2000 | Jackson | B41J 2/2135 347/19 |
| 9,177,424 | B2 * | 11/2015 | Ortmann | G07B 17/00193 |
| 2003/0020774 | A1 | 1/2003 | Su et al. | |
| 2012/0033006 | A1 * | 2/2012 | Murayama | B41J 2/2135 347/14 |

FOREIGN PATENT DOCUMENTS

DE 20 2014102699 U1 6/2014

* cited by examiner

*Primary Examiner* — Henok D Legesse
(74) *Attorney, Agent, or Firm* — Schiff Hardin LLP

(57) ABSTRACT

An apparatus with an ink printing device generates imprints on items moving in a transport direction. The ink printing device displaces the ink cartridge, which is a single inkjet print head of at least 1 inch in width transverse to the transport direction, as well as in a vertical direction, and counter to the vertical direction. A movement mechanism of the printing module is provided to vertically raise and lower the inkjet print head. The movement mechanism has a mechanism for motorized movement of the inkjet print head, and a mechanism for manual displacement in the vertical direction.

13 Claims, 11 Drawing Sheets

APPARATUS FOR PROCESSING AND PRINTING ITEMS

BACKGROUND OF THE INVENTION

Field of the Invention

The invention concerns a processing apparatus equipped with an ink printing device to generate imprints on the items, which may be designed as a franking machine. A franking machine of this type is used in connection with peripheral apparatuses and with other mail processing apparatuses in a franking system, which is purchased or leased entirely or in part by a customer.

Description of the Prior Art

When the term print medium is used in the following, it encompasses print media such as flat goods, mail pieces, letter envelopes, postcards and the like.

A device for printing on a print medium standing on edge is described in European patents EP 788 073 B1 and EP 789 332 B1, which has at least one inkjet print head that has a printing width required for printing a franking imprint. A franking machine based on the aforementioned technology, with the registered trademark JETMAIL®1, was first presented at the CeBit97 trade fair in Germany in March 1997. A first design of one of three modules for an ink print head that has nozzles at a facing edge of the module, according to the edge shooter principle, is known from the European patent EP 581 395 B1. A specially pre-treated, photosensitive glass plate serves as a starting material for each module. Each inkjet print head may be composed of three modules. An additional design of two of the three modules for an ink print head is known from European patent EP 713 776 B1. However, such a design leads to distortions in the print image due to manufacturing tolerances that must be compensated for via an electronic control. Therefore, a method and an arrangement for tolerance compensation (EP 921 008 B1 and EP 921 009 A1) have been developed for an ink print head composed of multiple modules according to the "non-interlaced" principle. A highly integrated 1-inch inkjet print head was not yet available at that time. More recently, due to modern methods based on a silicon wafer technology for the manufacturing of nozzles in a nozzle plate (side shooter principle), a high precision is possible even given printing of a larger printing width (EP 2 576 224 B1).

From the U.S. Pat. No. 6,106,095, a franking machine with two ½-inch inkjet print heads is known, but it requires a printing of a control pattern. Since each of the two ½-inch inkjet print heads thereof prints only one half of the overall franking imprint, an alignment of both imprint halves is necessary. Since the two ½-inch inkjet print heads are offset not only transversely to the transport direction of the mail piece but also longitudinally in the transport direction of the mail piece, the necessary time offset is achieved by a time delay. The variation in the activation of the print heads relative to one another would be readily perceptible from the position of the two imprint halves of the print image of a predetermined print image. The control system prints a test pattern onto a surface of the mail piece and ensures that the print data signals that are sent to the pair of inkjet cartridges are coordinated so that they generate a qualitatively high-grade imprint of the print image. However, the adjustment of the standard time delay by a user of a franking machine to achieve a qualitatively high-grade imprint is time-consuming and differs from operator-to-operator. Each of the two ½-inch inkjet print heads is a component of a respective ink cartridge that has a limited ink reservoir. In order to replace consumed ink cartridges with ink cartridges filled with ink, the fresh cartridge is inserted into a print carriage of the printer module that has a sled that runs on two rails, moving transversely to the transport direction of the mail piece. The adjustment of the standard time delay must be performed after every exchange of one of the two ½-inch ink cartridges. The franking machine has an arrangement for repositioning the sled via its transversal movement, and a service assembly. The latter may only be moved orthogonal to the transverse movement. For this purpose, it is driven by a separate motor and may be moved in the transport direction, and opposite thereto. The service assembly may be driven by a sliding block guide onto the print heads when the sled is positioned in a service position. The service assembly and its drive thus do not have a simple design. Moreover, in a printing position, the clearance of the print heads above the print medium cannot be varied. This is disadvantageous if the print medium does not have a smooth surface but rather a coarsely structured or corrugated surface.

From German utility model DE 202010015351 U1, a device is known for lowering, positioning and raising contact pressure elements of a printing apparatus, in particular of a franking machine. A box-shaped modular unit is equipped with a supply table that has on the top side an opening for the contact pressure elements of a contact pressure device, wherein contact pressure elements are arranged so that they can be removed, which facilitates their servicing. In an operating position, the box-shaped modular unit is arranged below the printing device of the franking machine and may be removed from this position for the purpose of servicing. A mechanical connection element is arranged on the back side of the box-shaped modular unit. As soon as an internal lock is released, the box-shaped modular unit slides forward on two guide rails like a drawer and may be completely removed. After conclusion of the servicing, it may be brought entirely into the operating position again by sliding on the two guide rails, and continue to be used. The box-shaped modular unit may be removed for dust removal, for example. However, additional assemblies that can be contaminated with ink exist that, in order to be exchanged, require opening of the security housing of the franking machine.

In the PostBase®-type franking machine that is commercially available from Francotyp-Postalia GmbH, in order to generate imprints, a print medium is pressed by a contact pressure device against an ink printing device that contains a transport module that transports the print medium in a transport direction x during the printing. The ink printing device has a printing carriage with at least one exchangeable ink cartridge. The device has at least one ½-inch ink cartridge that is equipped with an ink print head that can be moved transversely to the transport direction x by the print carriage, for servicing.

In practice, franking machines are either purchased by or leased to the customers. After they have been returned by a first customer, each franking machine is updated to the most recent state before being leased further to a next customer. The need of future customers for an economical, modern printing technology in the franking machine might thereby be taken into account. However, that would require a significant expenditure in the refurbishing of the existing franking machines, and it would therefore be desirable to keep the expenditure for this as low as possible.

From German utility model DE 202012005904 U1, a franking machine is known in which all assemblies that can be contaminated with ink are arranged in the non-secure regions of the franking machine (i.e., regions that are not specially equipped or designed so as to make those regions tamperproof). That has the advantage that a franking machine that should be newly leased to a customer may be more simply retrofitted or serviced without it being necessary to open the security housing of the franking machine. One of the non-secure regions is situated within a box-shaped modular unit of the franking machine again, and another is accessible via a sealable opening in a floor plate of the lower housing part of the franking machine. Even though the sealable opening in the floor plate is suitable in principle to accommodate the assemblies that can be contaminated with ink for a different type of inkjet print head, problems occur given a subsequent use of other types of inkjet print heads. The frame of the franking machine of the PostBase® type, presents space problems if a 1-inch print head were to be used, because the frame was originally designed only for ½-inch ink cartridges from Hewlett Packard.

SUMMARY OF THE INVENTION

The object is to remedy the defects of the known achievements, to improve the precision upon printing an imprint by means of an inkjet print head, to increase the precision of the adjustment of the clearance of the inkjet print head above the print medium, and to further simplify the service device of the printing device of the goods processing apparatus. The present printing mechanism should thereby be significantly used further. A sub-object exists in remedying the space problem given use of a 1-inch ink print head in a franking machine of the PostBase® type. Another sub-object exists in enabling a manual displacement of the movement mechanism if the franking machine is without power and a motorized movement of the 1-inch print head is not possible, in order to bring the print carriage into a suitable position which allows an exchanging of the 1-inch ink print head.

The apparatus according to the invention has a printing module with a single 1-inch inkjet print head and is designed to displace the single 1-inch inkjet print head in the y-direction transversely to the transport direction x, and counter thereto, as well as in the orthogonal z-direction and counter thereto. It is known that a print carriage requires at least one ink cartridge holder and a sled that is installed so as to be movable on two guide rods. The guide rods are linear bearing and guidance elements of the sled. The guide rods are arranged in a frame, transversely to the transport direction x of the print medium, and are parallel to one another at a constant distance in the transport direction x; and extend in the direction y of a Cartesian coordinate system, the direction y being orthogonal to the transport direction x.

According to the invention, the print carriage with the ink cartridge holder is installed so as to be movable vertically on the sled. A movement mechanism is provided for vertically raising and lowering the 1-inch inkjet print head in the z-direction, and counter thereto. The 1-inch inkjet print head is a component of a 1-inch ink cartridge that is installed by being plugged into the ink cartridge holder. The 1-inch ink cartridge is installed under a lockable cap in an opening of an upper housing shell of the goods processing apparatus so as to be exchangeable, and is accessible from above. The raising and lowering of the 1-inch print head relative to the service station or the print medium to be printed on, and for exchanging the cartridge, are achieved by the movement mechanism installed in a frame of the apparatus. The 1-inch inkjet print head may be protected against drying out by sealing with a cleaning and sealing station (RDS) of suitable design. The RDS has a stationary sealing cap and is installed in a lower housing shell of the apparatus so that it can be exchanged through a lockable service opening. Due to the movement mechanism, the 1-inch inkjet print head can be coupled with the RDS without it being necessary to raise the RDS. The design of the service station (RDS) is thereby advantageously simplified.

The apparatus is, for example, a franking machine. All assemblies that can be contaminated with ink are furthermore situated in the non-secure regions of the franking machine. An ink capture container corresponding to the ink reservoir has a modular arrangement within the franking machine at a position situated between the service station and the floor plate of the lower housing part lower housing part, wherein all assemblies that can be contaminated with ink are accessible via a shaft-shaped opening in the floor of the lower housing shell of the franking machine. The service station may likewise be exchanged via the aforementioned shaft-shaped opening. The service cost is reduced because only a single service station is associated with the printing module having a single, 1-inch wide inkjet print head.

The precision in the printing of an imprint is further increased via the use of a single, 1-inch wide inkjet print head. Compared to the use of two ½-inch inkjet print heads in a printing module, the problems with the alignment of imprint halves of a print image are no longer present when only a single inkjet print head having a print width of 1 inch is used instead of two ½-inch inkjet print heads.

The inkjet print head may be precisely positioned by the movement mechanism, not only transversely to the transport direction of the print medium, but also at a distance from the surface of the print medium that is to be printed on. The advantageous precision of the adjustment of the clearance of the 1-inch ink print head above the print medium likewise contributes to improvement of the imprint. The movement mechanism for raising and lowering the 1-inch inkjet print head has a drive for motorized movement of the 1-inch inkjet print head in a direction z of the Cartesian coordinate system and counter thereto, this direction z being orthogonal to the transport direction x, as well as an adjustment mechanism for manual adjustment of the clearance of the 1-inch inkjet print head relative to the surface of the print medium lying on its side.

In an embodiment, the movement mechanism is equipped with a lifting bar and a balance shaft, the longitudinal axis of which is aligned in the y-direction, thus transversely to the transport direction x of the print medium. The movement mechanism allows raising and lowering of the print carriage, with the lifting bar remaining aligned parallel to the y-direction, thus transversely to the transport direction x. Respective pinions are attached non-positively and positively at both ends of the balance shaft. Toothed racks are attached to or molded on the lifting bars, projecting counter to the z-direction, thus in the direction of gravity, from the lifting bar. The toothed racks of the installed lifting bar run or slide in guides, the guides being molded in a carrier for the movement mechanism. The balance shaft is installed so that it can rotate on the carrier, and the toothed racks are arranged so as to be spaced counter to the x-direction from the balance shaft, but so close that the teeth of the toothed racks and the teeth of the pinion respectively engage with one another without play at a location on both sides of the balance shaft. One of the two toothed racks is molded on the first end of the lifting bar, and the respective other of the toothed racks is molded at a distance of 60% to 80%, preferably in a clearance range of ⅔ to 70% of the length L, from the first end. The lifting bar has a length L that is greater than the length of the carrier. A first end of the carrier is aligned with the first end of the lifting bar. The second end of the carrier is located at a distance from the first end that is 70% to 80% of the length L of the lifting bar, such that the lifting bar projects forward beyond the carrier. Due to elastic force and/or due to gravity, the lifting bar rests on the drive for motorized movement. The drive for motorized movement is installed on the carrier with an intervening space in the y-direction between the two toothed racks. The drive for motorized movement can be, for example, a linear stepper motor with an integrated lifting mechanism, the integrated lifting mechanism being designed to be self-locking and having a lifting rod that is parallel to the z-direction, and that can be extended in steps to a predetermined displacement length in the z-direction.

A stop that arrests the vertical displacement position is provided in combination with the mechanism for manual displacement. For manual displacement, the base of the lower housing shell of the franking machine additionally has a further opening via which a tool that is suitable for this purpose may be introduced, in order to operate the mechanism for manual displacement of the movement mechanism.

The mechanism for manual displacement is molded onto the underside of a carrier of the movement mechanism, and has a cylindrical sash lock mount with a central opening at a distance from the carrier, counter to the z-direction, as well as the stop for arresting the vertical displacement position. The mechanism for manual displacement is separated in the y-direction of the Cartesian coordinate system from the drive for motorized movement of the 1-inch inkjet print head. The stop for arresting the vertical displacement position is integrated into the mechanism for manual displacement formed by the sash lock that may be displaced with a tool.

Multiple different displacement positions may be achieved by the motorized movement of the lifting bar, and two different displacement positions may be achieved by a manual displacement, each displacement position corresponding to a predetermined distance in the z-direction of the 1-inch inkjet print head relative to the surface of the print medium to be printed on. The movement mechanism allows a raising and lowering of the 1-inch ink print head. That has the advantage that the service station may be of simple design since this needs to be neither lowered nor raised.

DESCRIPTION OF THE PREFERRED EMBODIMENTS

A known items processing apparatus—viewed from the front—transports print medium items from left to right during printing. The term "right" means situated in the transport direction x of a print medium item (not shown), or downstream, and the term "left" means situated counter to the transport direction x of a print medium item (not shown), or upstream. "Rear" means situated in the y-direction, and "upper" means situated in the z-direction of a Cartesian coordinate system.

The exemplary embodiments of the invention described herein assumes such an orientation apparatus, but the invention encompasses apparatuses that transport print media from right to left during printing. Given a perspective depiction from the rear, the terms "right" and "left" are then swapped. Therefore, in the following the terms "downstream" and "upstream" are used.

Figure 1A:
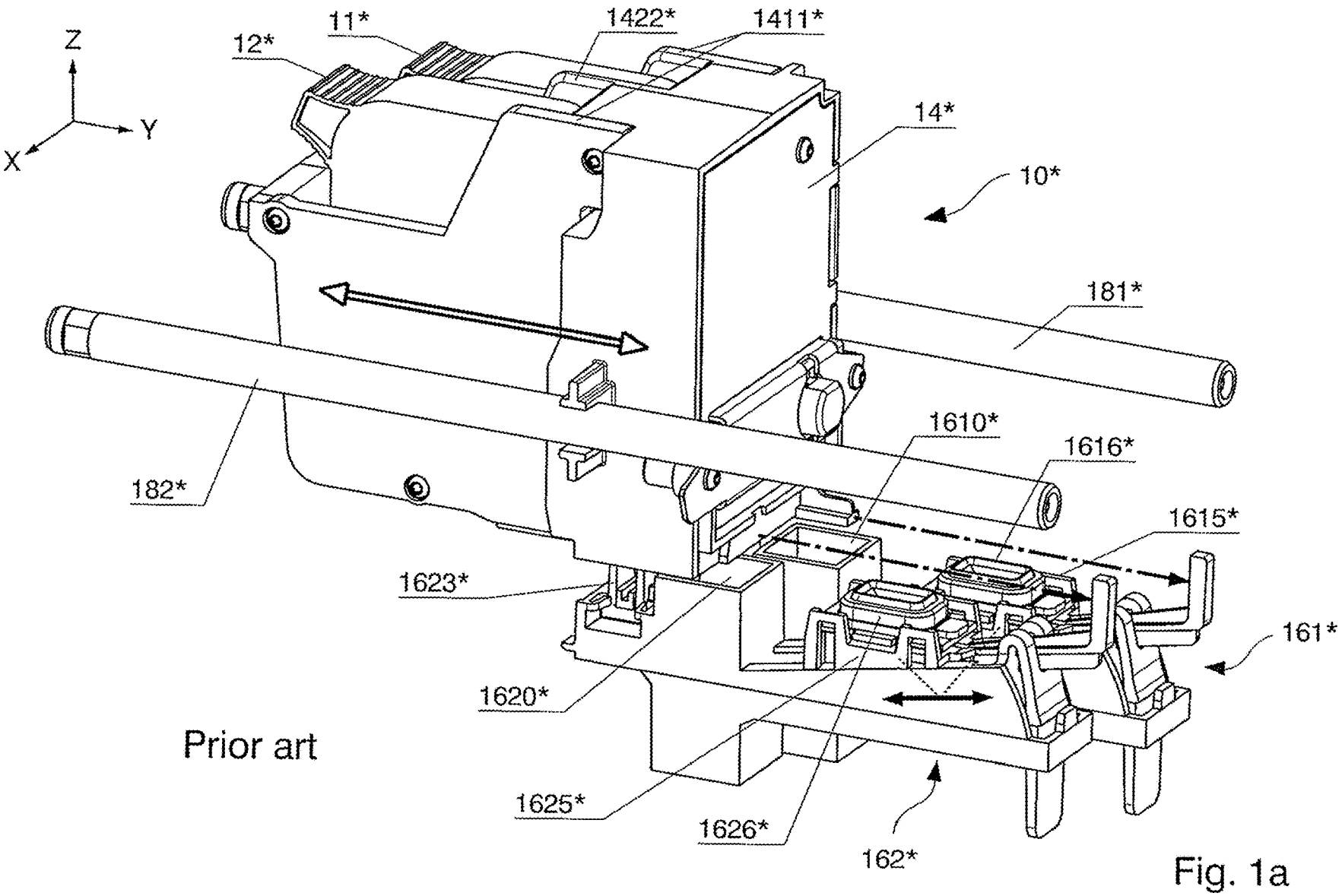
Fig. 1a Prior art
FIG. 1*a* is perspective view of a printing module in a printing position, together with two service modules of a known processing and printing apparatus, downstream from the upper rear.

FIG. 1*a* shows a perspective view of a printing module 10* from the upper rear, downstream, and in the printing position together with two service modules 161*, 162* of the known goods processing apparatus that transports print medium items from left to right during the printing. The printing machine 10* has a print carriage 14* with an installed cartridge holder for two ½-inch ink cartridges 11*, 12*. The ink cartridge 14* also includes a control electronics (pen driver board)—not visible—for the ½-inch ink print heads of the ink cartridges. The cartridge holder has two side walls 1411* and a middle wall 1412* and serves to accommodate the ink cartridge. The print carriage is designed as a sled that is borne sliding in a first direction (white arrow with two points) on two guide rods 181*, 182*. Associated with the two ink cartridges 11*, 12* are two service modules 161*, 162* whose seal caps are moved toward the two ink print heads of the ink cartridge in the event of service (the manner is not shown). The two service modules each have a purging shaft 1610*, 1620*, a sled 1615*, 1625* with a respective sealing cap 1616*, 1626*, and a respective wiping lip (1613*), 1623*. The wiping lip 1613* is covered by the printing module. The print carriage 14* moves in a first direction (white arrow with two points), and the sealing caps may be moved in a second direction (black arrow with two points) due to the movement of the sled 1615*, 1625*, wherein the sealing cap moves in the z-direction, thus is raised.

Figure 1B:
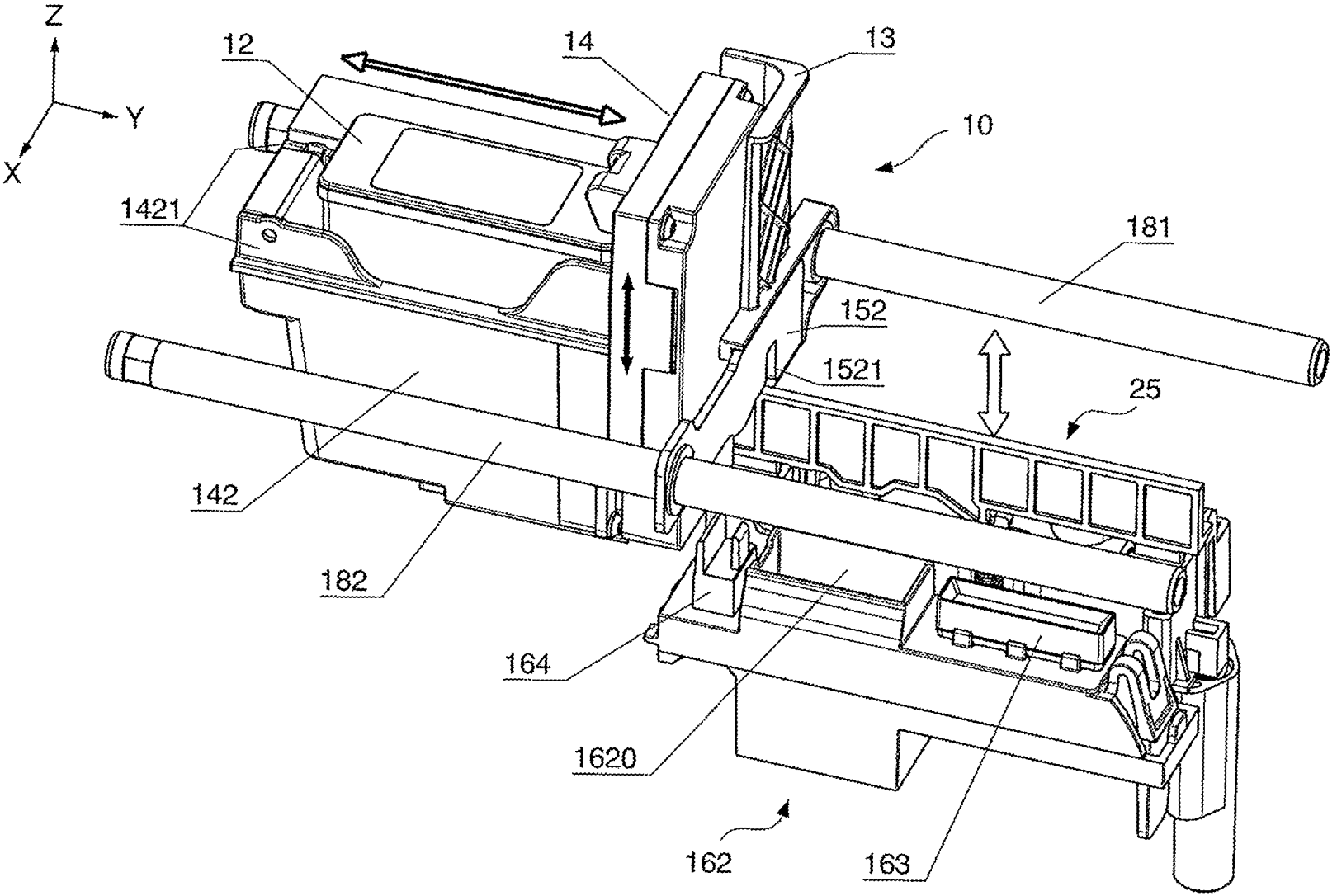
FIG. 1*b* is a perspective view of a printing module in a printing position, together with a movement mechanism according to the invention, and with a service module of a processing and printing apparatus, downstream from the upper rear.

FIG. 1*b* shows a perspective view of a printing module 10 in the printing position, together with a movement mechanism 25 according to the invention, and with an adapted service module 162 of a new goods processing apparatus, downstream from the upper rear. In the depiction, "downstream" is situated in the transport direction x of the print medium (not shown), "rear" is situated in the y-direction, and "upper" is situated in the z-direction of a Cartesian coordinate system. The printing module 10 has a sled 13 that can be moved in the y-direction and counter thereto, meaning transverse to the transport direction x, and a print carriage 154 that can be moved in the z-direction and counter thereto, i.e. that can be vertically displaced, said print carriage 14 having an ink cartridge holder 142 that is equipped to accommodate a single 1-inch ink cartridge. The print carriage 14 also includes control electronics (pen driver board)—not shown—for the 1-inch ink print head of the 1-inch ink cartridge. Via the sled 13 movable transversal to the transport direction x, the printing module 10 may occupy various positions, for example the service positions, the printing position, or the exchange position. The service positions include a sealing position, a purging position, and a cleaning position. In the sealing position—shown in FIG. 9—a single sealing cap 163, arranged stationary, of the single service module 162, is associated with the 1-inch ink print head 12 of the 1-inch ink cartridge. For better clarity, the service positions are not shown in FIG. 1*b*. The service module 162 has a wiping lip 164, a purging shaft 1620, and a sealing cap 163. However, in the event of service the latter is not moved toward the ink print head of the ink cartridge, especially as the service module lacks a sled for this. The 1-inch ink print head may be raised or lowered onto the sealing cap 163 in the service position (thin white double arrow) by the movement mechanism 25 according to the invention.

The cartridge receptacle of the ink cartridge holder 142 has respective upstream and downstream side walls 1421. The sled 13 slides on two guide rods 181, 182 so that the printing module 10 may be moved in the y-direction, from the depicted printing position into a service position and vice versa (thick white double arrow). The sled 13 has an arm 152 of an angle plate for guidance on the guide rod 182, wherein the arm 152 has a recess 1521 for the movement mechanism 25. The movement mechanism 25 has a drive for motorized movement of the 1-inch inkjet print head in the z-direction of the Cartesian coordinate system that is orthogonal to the transport direction x of the print medium items, and counter thereto (black arrow with two points). The aforementioned drive is arranged so as to be movable vertically (thin white double arrow), which is explained in detail further below using FIG. 4. Guidance elements for guidance of the ink cartridge holder during the raising and lowering of the 1-inch inkjet print head are provided at the sled 13 (FIG. 2).

Figure 2:
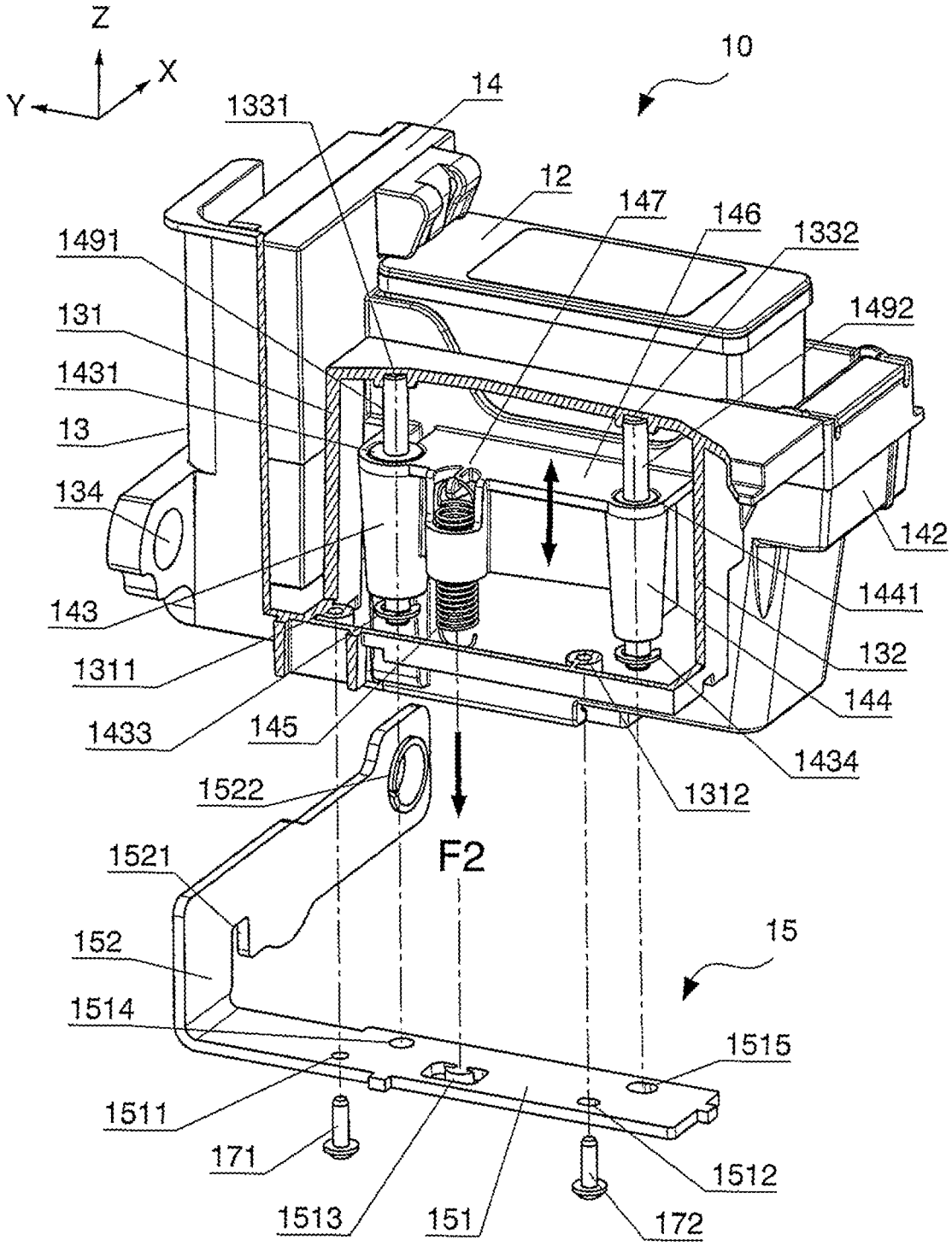
FIG. 2 is perspective view of a printing module, partially in section and not yet finally installed, with inserted 1-inch ink cartridge, upstream from the upper front.

FIG. 2 is a perspective view, upstream from the upper front, of a printing module 10 in partial section, which is not yet fully installed, into which printing module 10 is inserted a 1-inch ink cartridge 12. The sled 13 is movable in the y-direction and counter thereto, and the print carriage 14 is movable in the z-direction and counter thereto (black arrow with two points).

The print carriage 14, which can be displaced vertically in the z-direction and counter thereto, has two guide axles 1491, 1492 that are installed in receptacles 1331, 1332 of a bay 136 (FIG. 3*a*) molded on the sled 13, and in bearing holes 1514, 1515 of a bearing plate 151 of an angle plate 15, wherein the angle plate 15 is likewise installed on a sled. The sled 13 and the print carriage 14 have already been installed at the printing module 10. An angle plate 15 is depicted ejected, in a state in which it has not yet been installed. The angle plate 15 has the bearing plate 151 as a base and an arm 152 bent at a right angle, which together form an L-profile. An opening with a hook-shaped mounting means 1513 for an eye of the second tension spring 145 is incorporated into the middle of the bearing plate 151, and on both sides of the opening additional openings are incorporated, wherein the latter respectively form a bearing hole 1514, 1515 for the two guide axles 1491, 1492. The bearing plate 151 is situated in the x/y-plane and is designed to be longer than the arm 152, which is situated in the x/z-plane and from whose end a plate piece is bent in the x-direction, wherein the plate piece is longer than the arm 152. A recess 1521 for the movement mechanism is incorporated at the beginning of the plate piece. Installed at the end of the plate piece is a slide bearing 1522 in an opening of the plate piece, wherein the slide bearing 1522 is provided for sliding on the one guide rod 182. The sled 13 is designed for sliding on the other guide rod 181 (FIG. 1*b*). For this purpose, guide holes 134 (FIG. 2) and 135 (FIG. 3*a*) are provided at the sled 13.

The bearing plate 151 is installed at the sled 13 and has two through-holes 1511, 1512 for attachment by means of bolts 171, 172 at the sled 13. For this, the sled 13 has two side walls 131, 132, as well as two threaded bores 1311, 3112, for the screws 171, 172, at the side wall 131 and at the floor at a distance from the side wall 132. The side walls 131, 312 and the left side wall form a bay, open at the bottom that is closed by the installed bearing plate 151. For better clarity of the installation of the print carriage 14, the sled 13 is depicted cut away at an upstream side wall of the bay. Two receptacles 1331, 1332 for the two guide axles 1491, 1492 of the cartridge holder 142 of the print carriage 14 (FIG. 2) are integrally molded on the underside of the top of the bay. The guide axles 1491, 1492 are installed parallel to one another in the receptacles 1331, 1332 of the underside of the top of the bay and the bearing holes 1514, 1515 of the bearing plate 151. A respective retaining washer 1433, 1434 is installed at the respective lower end of the guide axles 1491, 1492, which retaining washers prevent the guide axles 1491, 1492 from sliding downward through the bearing holes 1514, 1515.

Figure 4:
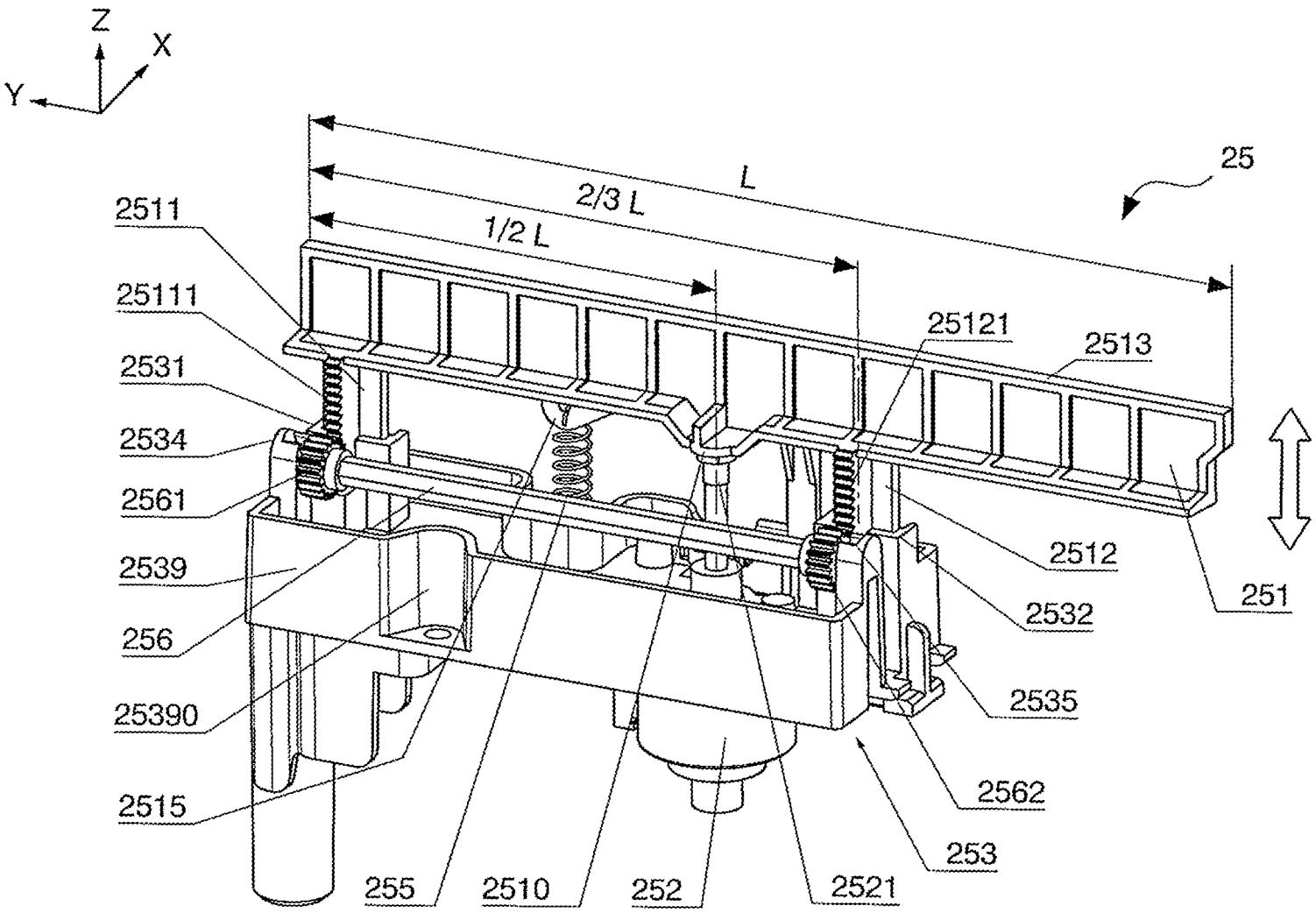
FIG. 4 is perspective view of the movement mechanism, upstream from the upper front.

The second tension spring 145 exerts a second spring force F2 and must be tensioned for mounting, wherein a force that is greater than the second spring force F2 must be applied in the direction of the black arrow after the bearing plate 151 has been installed at the sled 13. The other eye of the tension spring 145 has been mounted beforehand in a hook-shaped spring mounting element 147 of a lateral projection 146 of the cartridge holder 142 of the print carriage 14. The print carriage 14 is biased downwardly in the direction of the black arrow (FIG. 2) by the tension spring 145 installed at the cartridge holder 142, with the second spring force F2, up to a stop of a rest contour (detail D, FIG. 11) of the print carriage 14. The print carriage 14 may be raised counter to the spring force F2 by the movement mechanism (FIG. 4). It is provided that the lateral projection 146 at the cartridge holder 142 has columnar receptacles 143, 144, wherein the rear columnar receptacle 143 is provided for a bearing sleeve 1431 and the forward columnar receptacle 144 is provided for a short bearing bushing 1441, wherein the rear guide axle 1491 is mounted so as to slide in the bearing sleeve 1431 and the forward guide axle 1492 is mounted to as to slide in the short bearing bushing 1411. The columnar receptacles 143, 144 are molded in identical lengths at the lateral projection 146 and extend in the direction of gravity, meaning counter to the z-direction. The columnar receptacle 143 is situated after the columnar receptacle 144 in the y-direction. The short bearing bushing 1441 is pressed into an upper opening of the forward columnar receptacle 144, which ensures that the cartridge holder 142 remains aligned parallel to the bearing plate 151 during raising or lowering. The bearing sleeve 1431, which is provided for precise guidance of the cartridge holder 142, is pressed into an upper opening of the rear columnar receptacle 143.

Figure 3B:
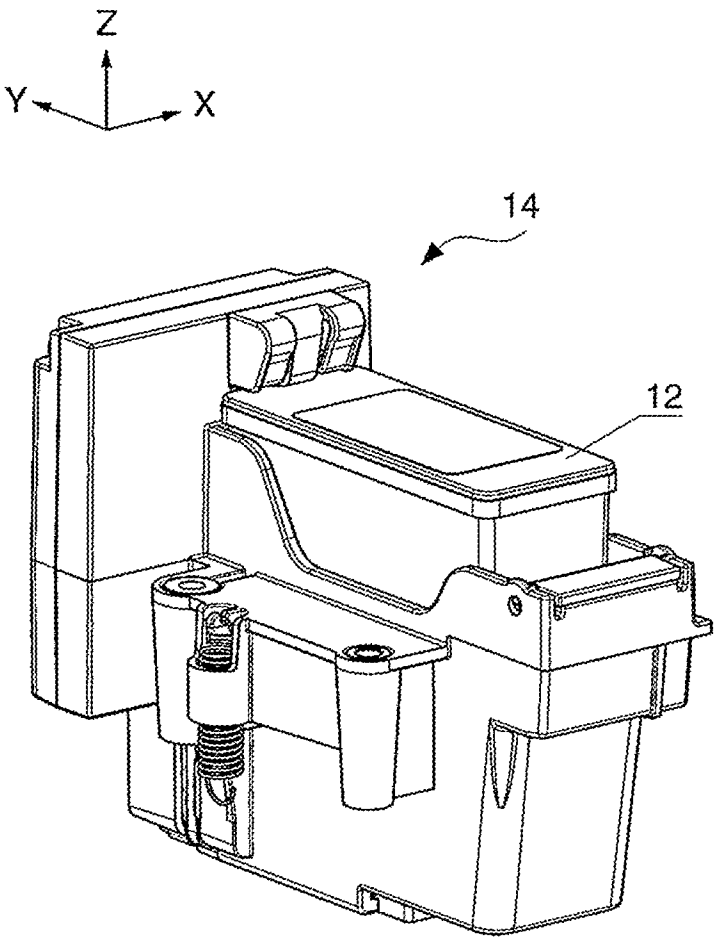
FIG. 3*b* is a perspective view of the print carriage, downstream from the upper front.
Figure 3A:
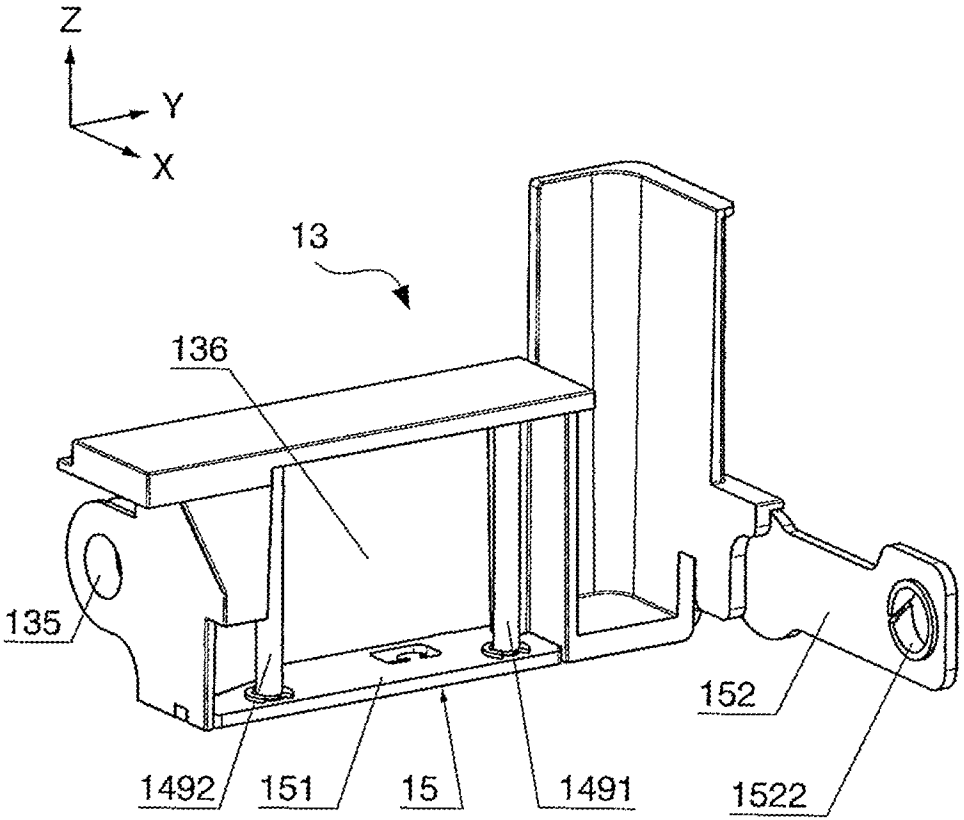
FIG. 3*a* is a perspective view of the sled, upstream from the upper front.

A perspective depiction of the sled 13 is shown in FIG. 3*a*, upstream from the upper front. The angle plate 15 is attached to the floor of the sled 13 in order to clarify the finished installed state. The bearing plate 151 of the angle plate 15 serves for attachment of the guide axles 1491, 1492 of the print carriage 14 in the molded bay 136 of the sled 13. The sled 13 is open in the x-direction, and a plate piece 1523 of the arm 152 of the angle plate 15 projects at the rear part of the sled 13. Only one guide hole 135 of the sled 13 is visible, and the other guide hole 134 of the sled 13 is covered but depicted in FIG. 2. The slide bearing 1522 in the plate piece 1523 likewise has a guide hole. All three guide holes are circular and have a diameter of identical size.

A perspective view of the print carriage 14, downstream from the upper front, is shown in FIG. 3*b*, into which print carriage 14 a 1-inch ink cartridge 12 is inserted.

Figure 5:
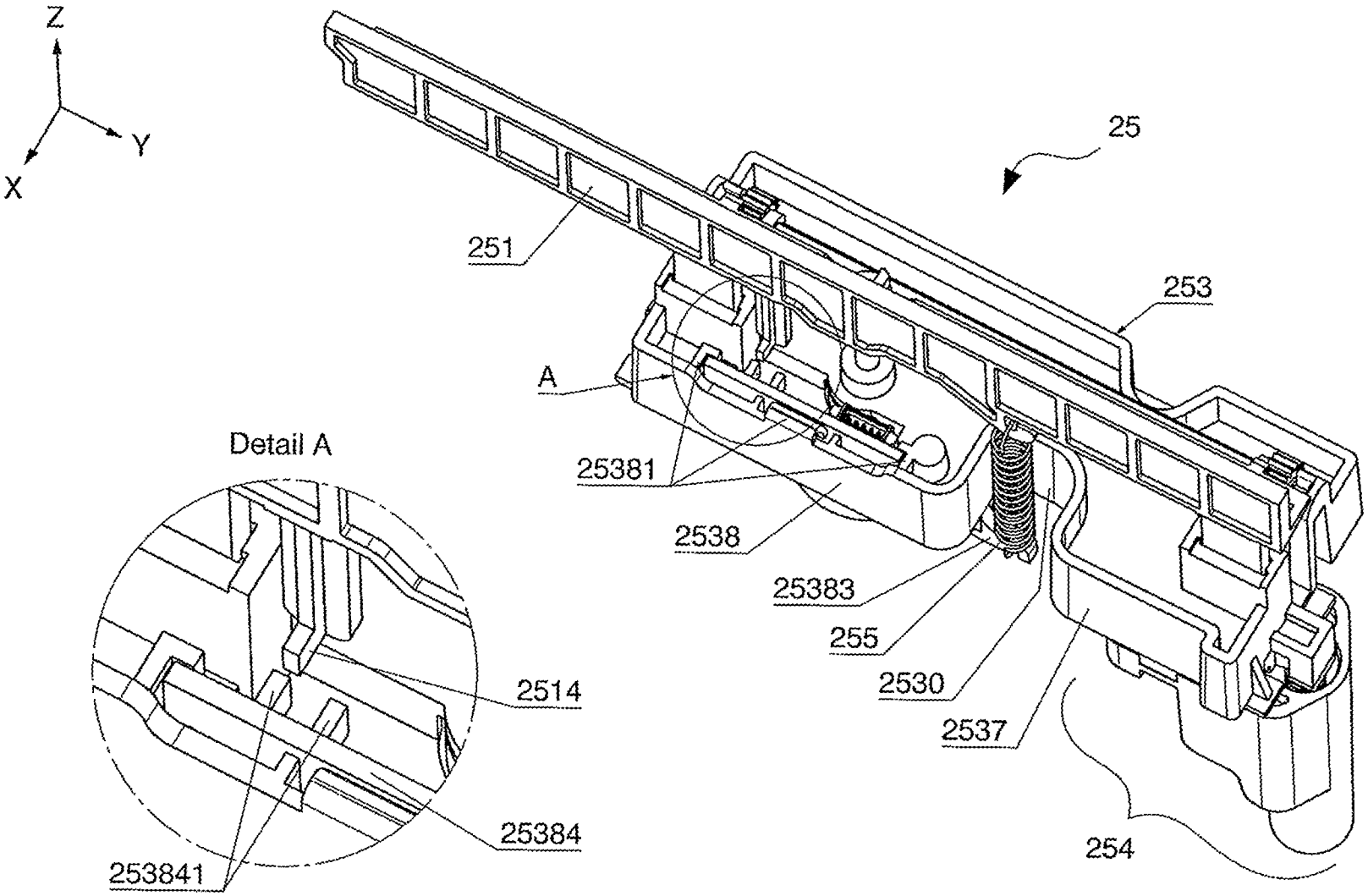
FIG. 5 is a perspective view of the movement mechanism, downstream from the upper rear.

A perspective view of the movement mechanism 25, upstream from the upper front, is shown in FIG. 4. A lifting bar 251 is installed so that it can be vertically displaced on a carrier 253 of the movement mechanism 25 and extends in the y-direction. It is provided that the lifting bar 251 is designed for raising or lowering the vertically displaceable print carriage 14 in the z-direction, or counter to the z-direction, which enables a shifting of the print carriage transversal to the transport direction x if the print carriage (14) is raised. The movement mechanism 25 is equipped with a lifting bar 251 having a predetermined length L parallel to the y-direction, and with a balance bar 256 whose longitudinal axis is aligned parallel to the y-direction—thus transversal to a transport direction x of a print medium (not shown)—and at whose ends pinions 2561, 2562 are respectively non-positively and positively attached. The two ends of the balance shaft 256 run in bearing shells 2534, 2535 of the carrier 253. Toothed racks 2511, 2512 counter to the z-direction, thus in the direction of gravity, are attached to or molded on the lifting bar 251, sticking out from said lifting bar 251. The toothed racks of the installed lifting bar have a T-shaped guide profile and run or slide in correspondingly shaped guides 2531, 2532. The guides are integrally molded in the carrier 253 of the movement mechanism 25. The toothed racks 2511, 2512 have a suitable toothed profile 25111, 25121 in order to enable a force compensation and synchronous movement compensation without the teeth of the toothed racks being overloaded and damaged. Toothed racks with a suitable tooth profile has [sic] a tooth modulus m=0.3 to 0.7; given toothed racks made of plastic, a tooth modulus m=0.5 to 0.7 is preferably used. The tooth modulus m is a measure of the size of the teeth of gears and is defined as the quotient of the gear index p (the pitch of two adjacent teeth) and $\pi$. The toothed racks 2511, 2512 are spaced from the balance shaft 256, counter to the x-direction, but arranged so close that, on both sides of the balance shaft, the teeth of the toothed racks 2511, 2512 and the teeth of the pinions 2561, 2562 respectively engage with one another at a location without play. The toothed rack 2511 is molded at the first (rear) end of the lifting bar, and the respective other toothed rack 2512 is molded at a distance by 60% to 80% of the length L from the rear first end of the lifting bar, preferably in a distance range of ⅔ to 70% of the length L of the lifting bar. The length L of the lifting bar is in a range of 6 to 7 inches, preferably at 6.5 inch=167 mm). The lifting bar 251 has a height that extends in the z-direction up to a flat travel surface 2513 at the upper edge. The lifting bar 251 has a bend at the lower edge and thus forms a non-isosceles L-profile. A contact surface 2510 is provided in the middle (approximately ½ L). At a distance of approximately ⅓ L from its rear end, the lifting bar 251 has at the lower edge a hook 2515 or a different spring mounting means for a tension spring 255. The other end of the tension spring is attached to the carrier (FIG. 5). The carrier 251 is equipped with four side walls that are arranged in the shape of a box. The upstream side wall 2539 of the carrier 253 has an indentation 25390 at a distance of approximately ¼ L from the rear end of the lifting bar 251. A linear stepper motor 252 is installed at the carrier 253 and has a lifting rod 2521, at the end of which is provided a placement plate on which the lifting bar rests due to the acting spring force and/or gravitational force with a contact surface 2510. A molded body of the lifting bar 251 is adapted in its dimensions to the length of the lifting rod and bears the contact surface 2510. The placement plate presses on the contact surface 2510. The lifting bar 251 is situated centrally on the lifting rod and can be displaced vertically (white double arrow).

As an alternative to the linear stepper motor, a different drive with a motor of a different type is also possible that is attached to the carrier 253. The drive has an encoder and a number of sensors, as well as an external transmission with a lifting rod. The placement point is distanced, preferably by half of the length L, from the first end of the lifting bar 251.

FIG. 5 shows a perspective depiction of the movement mechanism 25, downstream from the upper rear. The movement mechanism 25 is arranged in a frame (not shown). The downstream side wall of the carrier 253 has an additional indentation 2530 for the tension spring 255. The tension spring 255 is installed with its one end at the hook 2515 or another suitable spring mounting means of the lifting bar 251, and with its other end at the hook 25383 for spring mounting at the carrier 253. The two hooks are arranged one above another at a distance. The downstream side wall of the carrier 253 is subdivided by the indentation 2530 into two sub-parts 2537, 2538. The first sub-part 2537 is situated at a rear end and has a mechanism 254 for manual displacement of the lifting bar 251. The second sub-part 2583 is situated at the forward end and has clamp mounts 25381 for a sensor circuit board. A cutout with the sensor circuit board 25384 is shown enlarged in detail A. A forked light barrier 253841 of the sensor circuit board 25384 interacts with a switching cam 2514 of the lifting bar 251 and emits a signal if said switching cam 2514 enters into the intervening space between transmitter and receiver of the forked light barrier and/or leaves this again. The means for manual displacement are installed at the underside of the carrier 253 of the movement mechanism 25 and extends in the direction of gravity, meaning counter to the z-direction.

Figure 6:
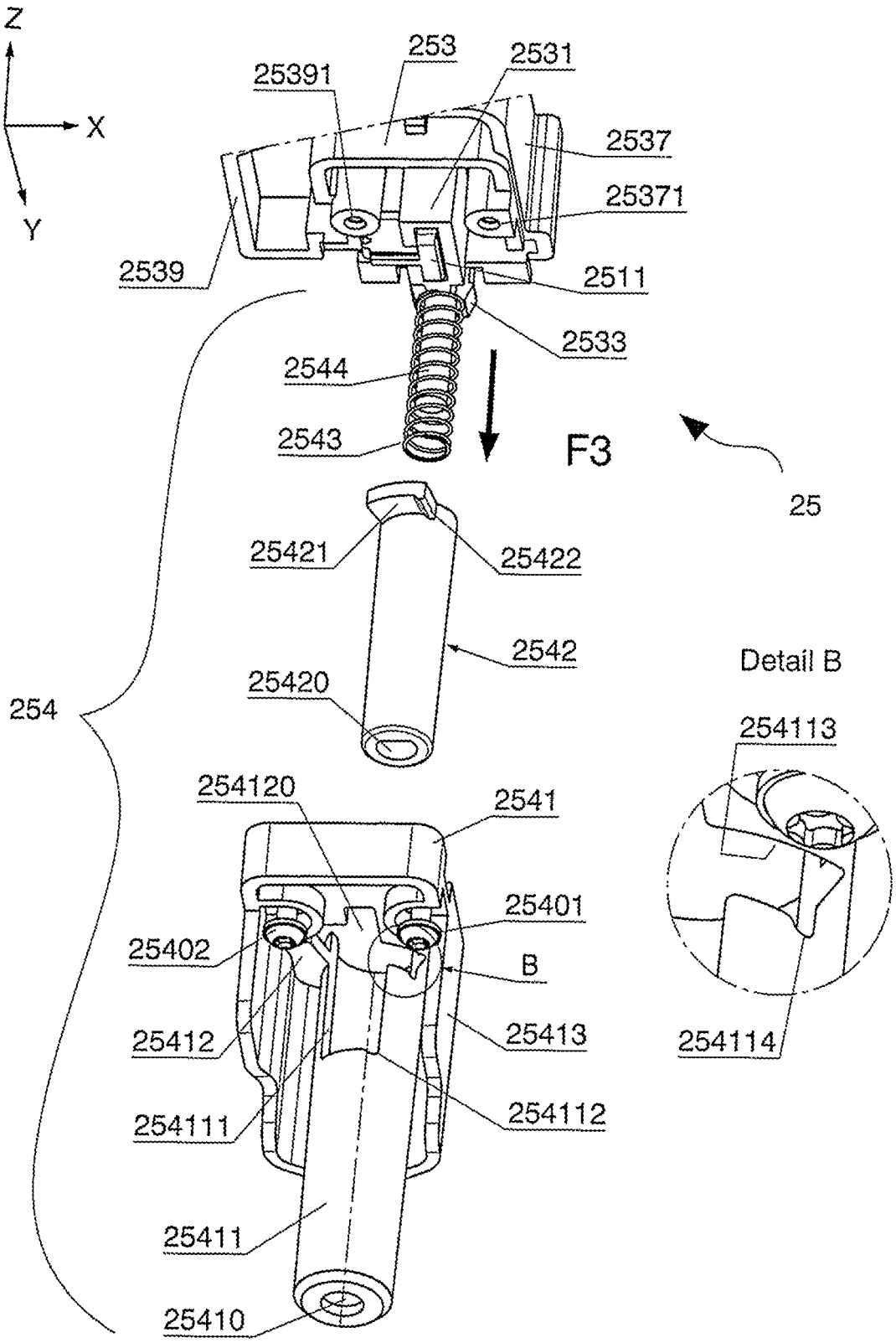
FIG. 6 is a perspective, exploded view of the mechanism for manual displacement, downstream from the lower front.
Figure 7:
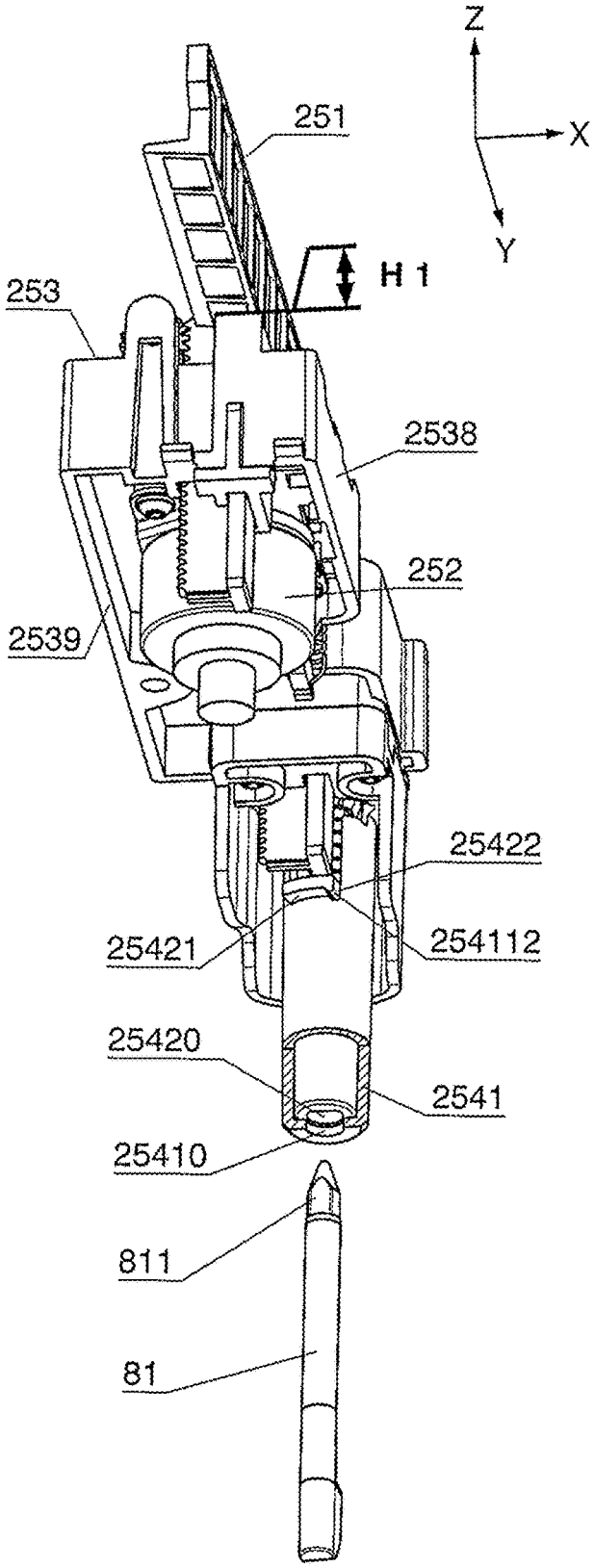
FIG. 7 is a perspective view of the mechanism for manual displacement, from the lower front right, before the manual displacement.

FIG. 6 shows a perspective, exploded view of the mechanism 254 for manual displacement, downstream from the lower front. These manual adjustment mechanism 254 of the movement mechanism 25 includes a sash lock mount 2541, a sash lock 2542, a compression spring 2543, and a pin 2544. The sash lock 2542 has a molded hole 25420 and is operated by a tool (not shown). The tool is preferably a multifunction pin 81 (FIG. 7). The sash lock mount 2541 has a cylindrical guide 25411 with a central opening 25410 at a distance, counter to the z-direction, from a base plate 25412 of the sash lock mount 2541. The opening 25410 is adapted to the outer diameter of the tool 8. The cylindrical guide 35411 is supported by a support wall 25413 which surrounds the cylindrical guide 35411 on three sides, whereas one side remains free for screwing down the sash lock mount 2541, at which one free side the base plate 25412 has openings counter to the y-direction for two bolts 25401, 25402. An opening 254120 in the cylindrical guide 35411 at the base plate 25412 serves for the insertion of the sash lock 2542 into the cavity of the cylindrical guide 35411. A crank 354111 is integrally molded into the shell surface of the cylindrical guide 35411, near to the aforementioned opening 254120, so that—as seen from the front—an opening with L-shaped recess 254113 formed mirror-inverted results that is provided for a bar lug 25421 of the of the sash lock 2542. The opening of the crank 354111 is situated counter to the y-direction and has an exposure 254112 for a retention lug 25422 of the sash lock. The L-shaped recess 254113 of the opening in the crank 354111 of the sash lock mount 2541 has a locking groove 254114 for the retention lug of the sash lug 2542, which is shown enlarged in detail B. The sash lock 2542 is designed as a means for locking the vertical displacement position. Given manual displacement, two different displacement positions may be achieved for minimum or maximum raising of the lifting bar 251, wherein each vertical displacement position—except for the vertical displacement position in the sealing position—corresponds to a predetermined distance of the 1-inch inkjet print head relative to the surface to be printed of a print medium (not shown) in the z-direction. A pin receptacle 2533 for the pin 2544 is molded on a rear side wall between the first sub-part 2537 at the rear end of the downstream side wall of the carrier 253 and the upstream side wall 2539 at the rear end of the carrier 253. A threaded hole 25371 for the screw 25401 is provided on the inside of the first sub-part 2537. An additional threaded hole 25391 for the screw 25402 is provided situated oppositely on the other side, at a distance from the upstream side wall 2539. The guide 2531 of the toothed rack 2511 with T-shaped guide profile is provided between the two threaded holes 25371 and 25391. The compression spring 2543 is installed on the pin 2544 and, in the installed state, exerts a spring force F3 (black arrow) on the sash lock 2542. The bar lug 25421 of the sash lock 2542 is pressed into the opening with the exposure 254112, wherein a vertical displacement position with a minimum raising of the 1-inch inkjet print head results (FIG. 7).

FIG. 7 shows a perspective view of the mechanism 254 for manual displacement, downstream from the upper front, in the installed state and before a manual displacement is performed. The mechanism 254 for manual displacement includes the sash lock with the molded hole 25420, which is adapted to the shape of the head 811 of the multifunction pin 81. The sash lock mount 2541 is shown cut away at the end in order to clarify that the molded hole 25420 of the sash lock 2542 is arranged directly below the opening 25410 of the sash lock mount 2541. The bar lug 25421 of the sash lock 2542 adjoins the lower edge of the opening with the exposure 254112 in which the retention lug 25422 rests. A stroke H1 illustrates a minimum vertical displacement position of the lifting bar 251. The mechanism 254 for manual displacement is at a distance, in the y-direction of the Cartesian coordinate system, from the drive for motorized movement of the 1-inch inkjet print head.

The aforementioned drive for motorized movement includes the linear stepper motor 252, which is arranged between the second sub-part 2538 of the right side wall of the carrier 253 and the left side wall 2539.

Figure 8:
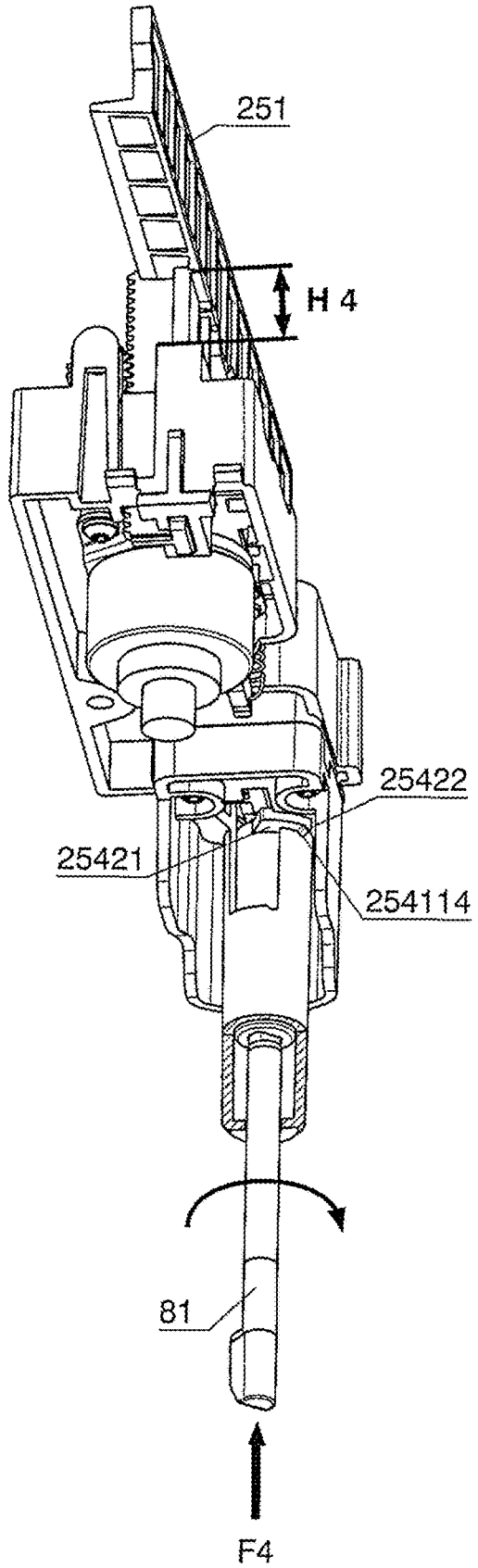
FIG. 8 is a perspective view of the mechanism for manual displacement, downstream from the lower front, after the manual displacement.

FIG. 8 shows a perspective view of the mechanism 254 for manual displacement, downstream from the lower front, after the manual displacement. The head of the multifunction pin 81, inserted into the opening 25410 of the sash lock mount 2541, projects into the molded hole 25420 of the sash lock 2542, which is shown displaced by an operator in the z-direction with a force F4. The bar lug 25421 of the sash lock 2542 was (manually) rotated counter-clockwise and is situated with the retention lug 25422 in the locking groove 254114. The stroke H4 illustrates a maximum displacement position of the lifting bar 251.

Figure 9:
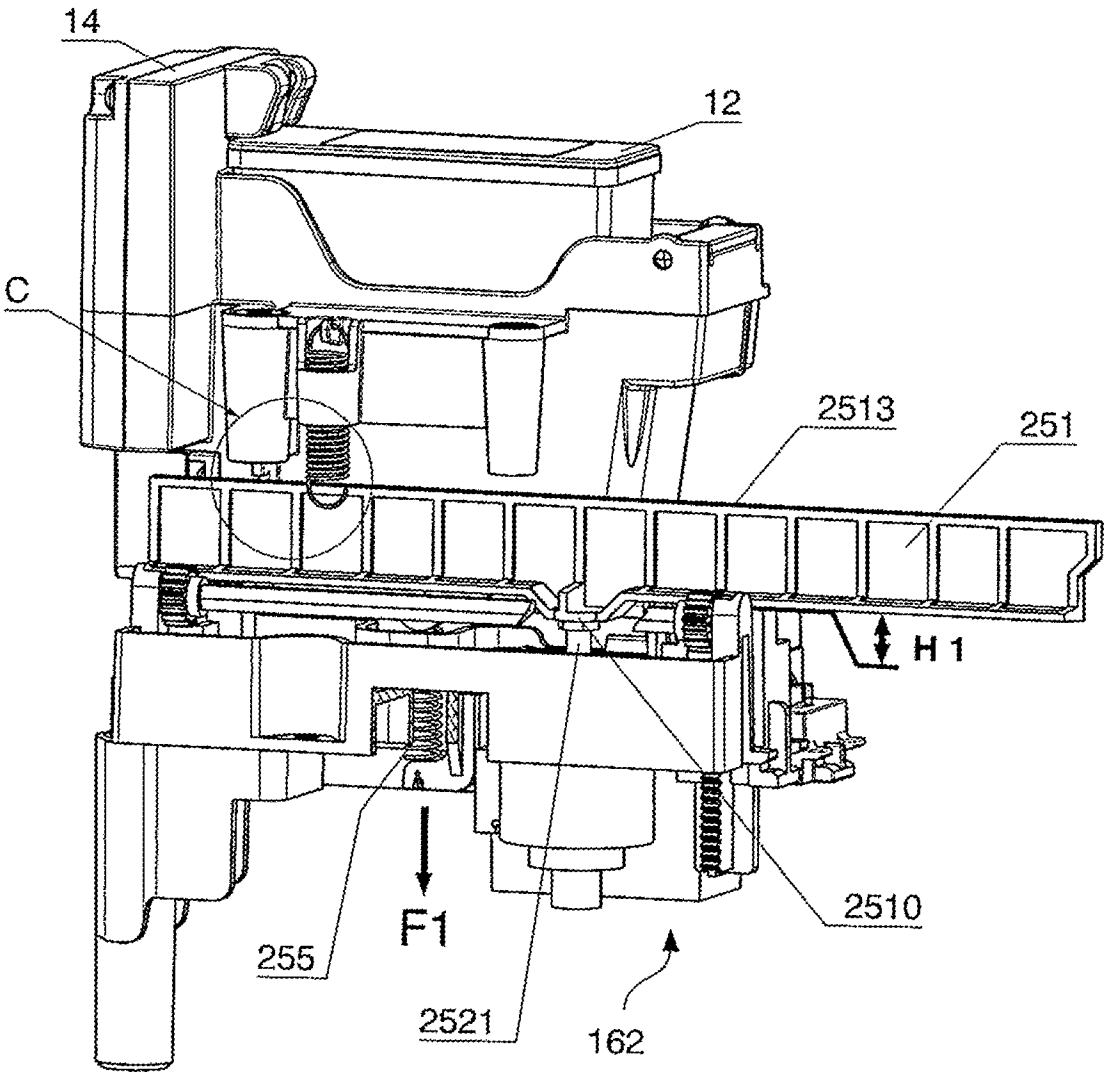
FIG. 9 is a perspective view of the movement mechanism, upstream from the upper front, in state H1.
Figure 9:
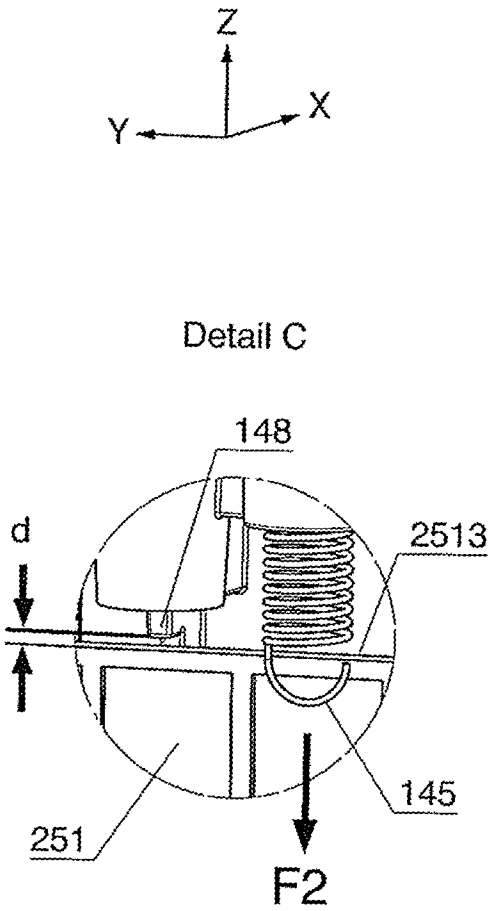

FIG. 9 shows a perspective view of the movement mechanism, upstream from the upper front, in the state of a stroke H1 before a motorized displacement. A 1-inch ink cartridge 12 is inserted into the print carriage 14. The sled of the printing module is not shown as well, merely for the sake of clarity. Arranged under the 1-inch inkjet print head of the 1-inch ink cartridge is the service module 162 which is partially covered by the movement mechanism. A first tension spring 255 draws the lifting bar 251 with the spring force F1 (black arrow) downward only until the contact surface 2510 of the lifting bar strikes the rest plate of the lifting rod 2521.

It is additionally provided that, in the vertical displacement position of the sealing position, the 1-inch inkjet print head rests on a stationary sealing cap of the service module 162, wherein the stationary sealing cap is adapted to the dimensions of the 1-inch inkjet print head, and the running surface 2513 of the lifting bar 251 has a distanced from the support contour 148 of the print carriage 14. The lifting bar 251 has a flat running surface 2513 that enables a displacement of the print carriage 14 transversal to the transport direction x. A second tension spring 145 that is installed between the print carriage 14 and the bearing plate 151 of the angle plate 15 (FIG. 2), wherein the bearing plate 151 is installed at the sled (13; see FIG. 3*a*), acts with the spring force F2 on the print carriage 14. If the sled (13; see FIG. 3*a*) has been vertically displaced in the y-direction into the sealing position (FIG. 9), transverse to the transport direction x and the lifting bar, then the 1-inch inkjet print head 12—charged by the spring force F2 of the second tension spring 145 (FIG. 2)—rests on the sealing cap 163 of the service station, shown in FIG. 1*b*.

The running surface 2513 of the lifting bar 251 thus does not rest on a support contour 148 of the print carriage 14; rather, it is positioned at a distance d, which is depicted enlarged in detail C. This displacement position requires only a stroke H1. The rise of the lifting bar 251 is zero (=minimum), wherein the minimum rise also corresponds to the initial state of the rise H1 via the means for manual displacement according to (FIG. 7).

Figure 10:
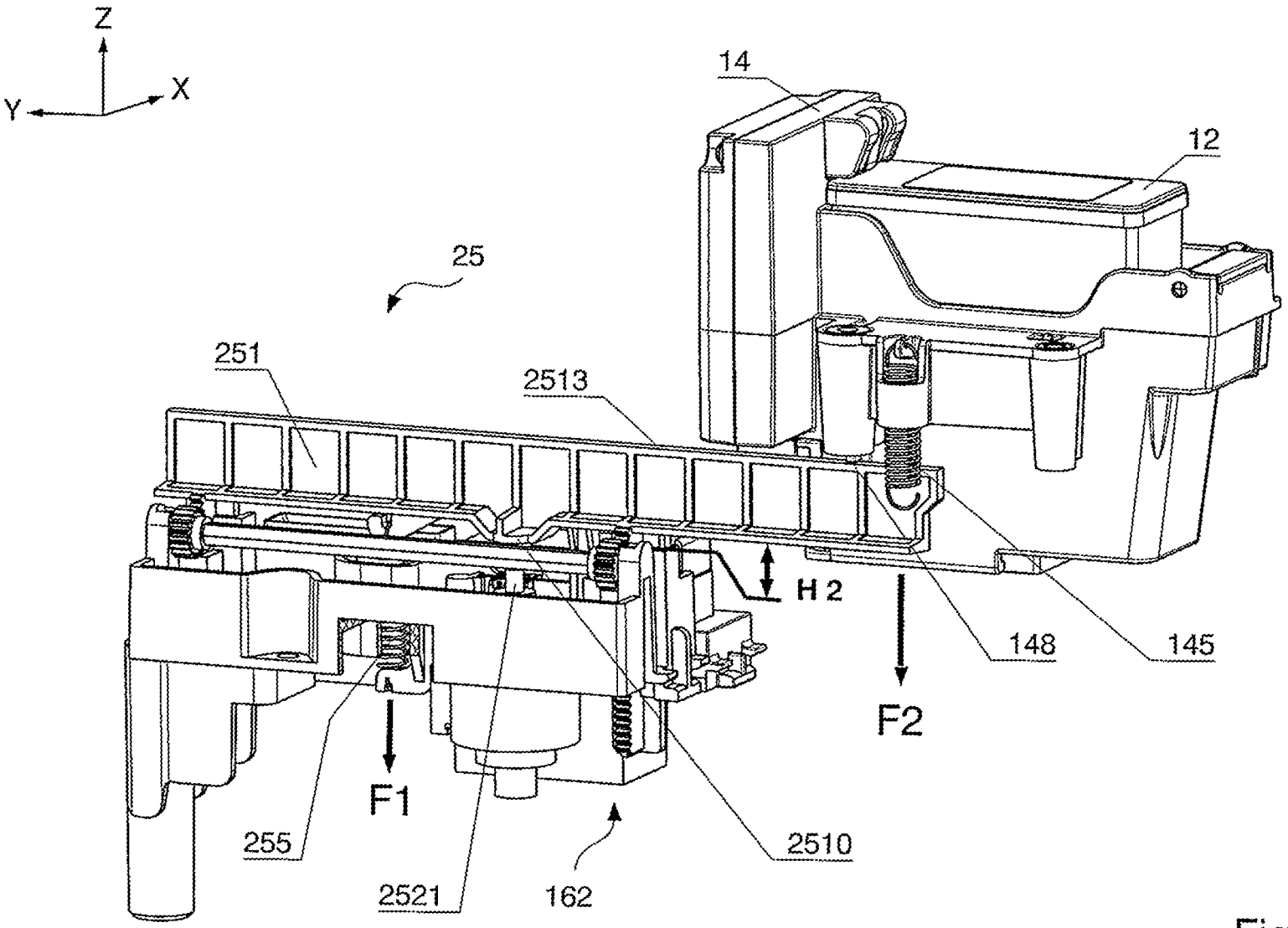
FIG. 10 is a view of the movement mechanism, upstream from the upper front, in state H2.
Figure 11:
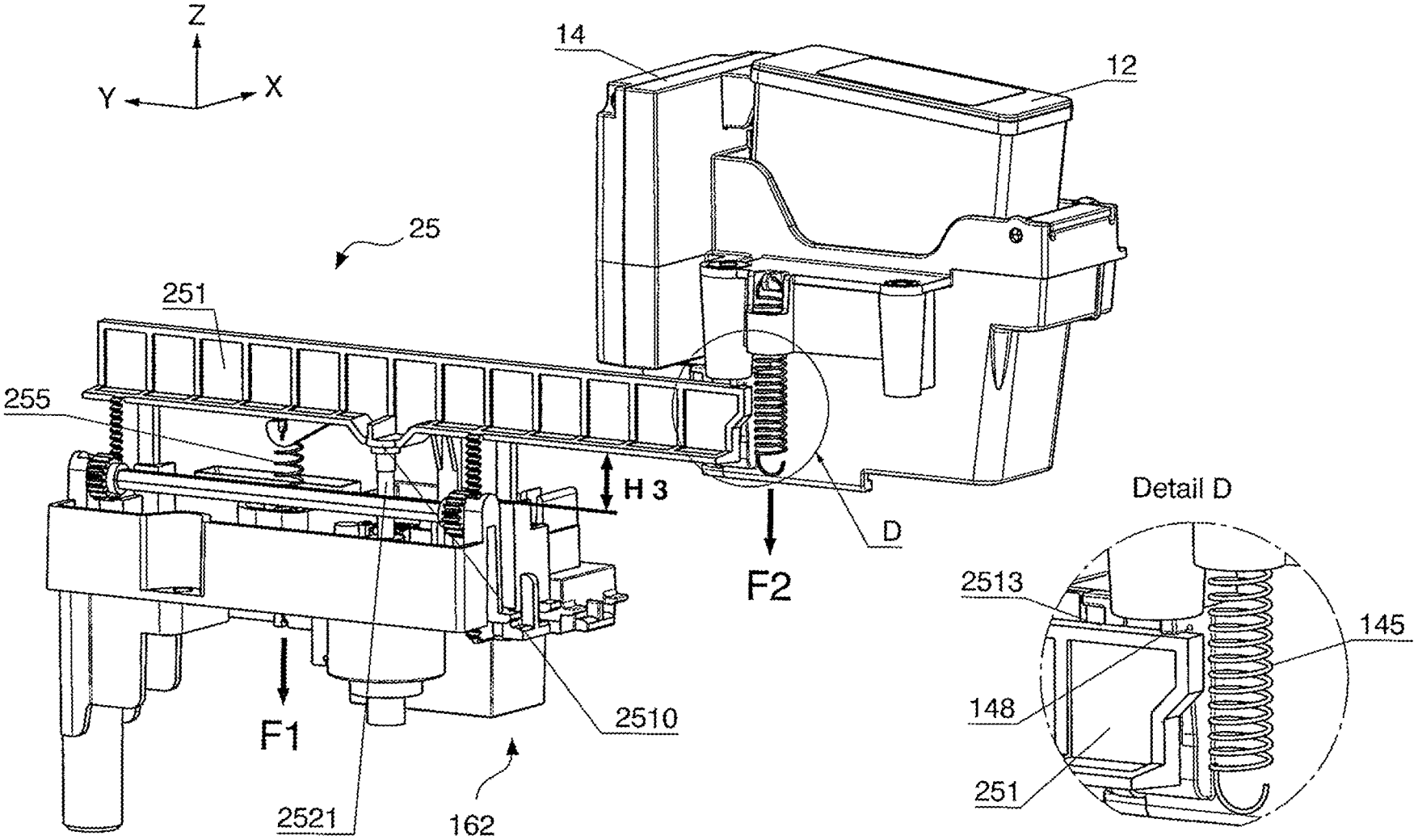
FIG. 11 is a perspective view of the movement mechanism, upstream from the upper front, in state H3.

FIG. 10 shows a perspective view of the movement mechanism 25, upstream from the upper front, in the state of a stroke H2. This vertical displacement position is situated between the minimum and maximum rise of the lifting bar 251 and is achieved via the means for motorized displacement. In contrast to the state shown in FIG. 9, the print carriage 14 was moved transverse to the transport direction x, counter to the y-direction, thus in the direction of the forward end of the lifting bar 251, into a printing position. A first rise of the print carriage 14 was thereby required. The correctly achieved vertical displacement position during the first rise may be detected by a control unit (not shown) by means of a forked light barrier 25384 (detail A, FIG. 5). Due to the spring force F2 of the second tension spring 145, the support contour 148 rests on the running surface 2513 of the lifting bar 251, and the distance d is zero, which is shown enlarged in detail D (FIG. 11). Any vertical displacement position, aside from that which exists in the sealing position, corresponds to a predetermined distance in the z-direction of the 1-inch inkjet print head relative to the surface of the print medium that is to be printed, with the support contour 148 of the print carriage 14 resting on the running surface 2513 of the lifting bar 251.

FIG. 11 shows a perspective view of the movement mechanism 25, upstream from the upper front, in the state of the stroke H3. In contrast to the state shown in FIG. 10, the print carriage 14 was moved farther to the forward end of the lifting bar 251, into an ink cartridge exchange position. A second raising of the print carriage 14 was thereby necessary. The correctly achieved vertical displacement position during the second rise may be computationally calculated by the control unit by counting the activation steps.

This vertical displacement position corresponds to a maximum rise of the lifting bar 251 in a state of the stroke H3, and is likewise achieved via the means for motorized displacement. The stroke H3 is identical to the stroke H4, and greater than the stroke H2 according to FIG. 10. For this exemplary embodiment, H4=H3>H2.

Although modifications and changes may be suggested by those skilled in the art, it is the intention of the Applicant to embody within the patent warranted hereon all changes and modifications as reasonably and properly come within the scope of the Applicant's contribution to the art.

The invention claimed is:

1. A printing apparatus comprising;

an apparatus housing;

a transport device that transports items through said apparatus housing in a transport direction x of a Cartesian coordinate system;

a printer in said housing comprising a single 1-inch ink jet print head that produces an imprint on respective items proceeding passed said printer on said transport device in said transport direction, said printer comprising a print carriage in which said 1-inch ink jet print head is exchangeably held so as to be accessible, for exchanging thereof, via a non-secure access opening in said apparatus housing, said print carriage being movable in a y-direction of said Cartesian coordinate system and counter thereto;

said print carriage, and said single 1-inch ink jet print head held therein, being displaceable in a vertical direction z of said Cartesian coordinate system, and counter thereto, by a movement mechanism in order to vertically raise and lower said single 1-inch ink jet print head; and said movement mechanism comprising a motorized movement train for motorized movement of said single 1-inch ink jet print head in said vertical direction and a manual displacement train for manual displacement of said single 1-inch ink jet print head in said vertical direction.

2. An apparatus as claimed in claim 1 wherein said printer comprises a sled that displaces said print carriage in said y-direction, and wherein said movement direction comprises a carrier with said manual displacement chain molded thereon, said manual displacement chain comprising a cylindrical sash lock mount with a central opening at a distance from said carrier, counter to said z-direction, and a lock that locks said manual displacement train in a locked vertical displacement position, and wherein said manual displacement chain in the y-direction is spaced apart from said motorized movement train.

3. An apparatus as claimed in claim 1 wherein:

the print carriage that can be displaced vertically in the z-direction and counter thereto has two guide axles that are installed in receptacles of a bay molded on the sled, and in bearing holes of a bearing plate of an angle plate, wherein the angle plate is likewise installed at the sled;

the print carriage has a cartridge holder, a lateral projection at the cartridge holder, having columnar receptacles, and a support contour wherein the columnar receptacle for a bearing sleeve and the columnar receptacle is provided for a short bearing bushing, wherein the rear guide axle is borne sliding in the bearing sleeve, and the forward guide axle is borne sliding in the short bearing bushing;

the movement mechanism is equipped with a lifting bar, in that the lifting bar is designed to raise or lower the vertically displaceable print carriage in the z-direction or counter thereto, and is equipped with a flat running surface that enables a displacement of the print carriage transversal to the transport direction x if the print carriage is raised;

every vertical displacement position, except for the vertical displacement position in the sealing position, corresponds to a predetermined distance in the z-direction of the 1-inch inkjet print head relative to the surface of the print medium to be printed to, wherein the support contour of the print carriage rests on the running surface of the lifting bar; and the 1-inch inkjet print head, in the vertical displacement position of the sealing position, rests on a stationary sealing cap of the service module, wherein the stationary sealing cap is adapted to the dimensions of the 1-inch inkjet print head, and the running surface of the lifting bar has a distance d from the support contour of the print carriage.

4. An apparatus as claimed in claim 1 wherein:

the movement mechanism is equipped with a lifting bar and with a balance shaft, in that its longitudinal axis and the lifting bar are aligned parallel to the y-direction, and in that respective pinions are attached to or molded on, non-positively and positively, at the ends of the balance shaft;

toothed racks with a guide profile are attached to or molded on the lifting bar, counter to the z-direction, and sticking out from said lifting bar;

the toothed racks of the installed lifting bar run or slide in guides, wherein the guides are molded on a carrier for the movement mechanism;

the balance shaft is installed so as to be rotatable at the carrier, wherein the toothed racks are arranged spaced apart from the balance shaft in the x-direction, but so close that the teeth of the toothed racks and the teeth of the pinions respectively engage with one another at a location on both sides of the balance shaft;

the means for motorized movement of the 1-inch inkjet print head in the z-direction and counter thereto comprise a motor that is coupled with a lifting mechanism that is installed at the carrier within an intervening space extending in the y-direction, between the two toothed racks, and the lifting bar rests on the lifting mechanism due to spring force and/or the force of gravity.

5. An apparatus as claimed in claim 4 wherein:

the lifting bar has a flat running surface and a length L=6 to 7 inches, which is greater than the length of the carrier;

a first end of the carrier aligns with the first end of the lifting bar, and in that the second end of the carrier is located at a distance of 60% to 80% of the length L of the lifting bar from the first end, such that the lifting bar projects forward from the carrier;

and in that one toothed rack of the two toothed racks is molded at the first end of the lifting bar, and the respective other toothed rack of the two toothed racks is molded at a distance of 60% to 80% of the length L from the first end of the lifting bar.

6. An apparatus as claimed in claim 5 wherein said lifting bar has a length L of 6.5 inches.

7. An apparatus as claimed in claim 4 wherein toothed racks with a T-shaped guide profile are molded on the lifting bar, counter to the z-direction and sticking out from said lifting bar; and in that the toothed racks have a suitable toothed profile in order to enable a force compensation and synchronous movement compensation without the teeth of the toothed racks being overloaded and damaged.

8. An apparatus as claimed in claim 4 wherein the motor is a linear stepper motor with integrated lifting mechanism that is designed to be self-locking, and has a lifting rod which is arranged situated parallel to the z-direction and can be extended in steps to a predetermined vertical displacement length in the z-direction.

9. An apparatus as claimed in claim 8 wherein a placement plate is provided at the end of the lifting rod, on which placement plate the lifting bar rests with a contact surface due to the acting spring force and/or the force of gravity.

10. An apparatus as claimed in claim 9 wherein an installed first tension spring exerts a first spring force F1 on the lifting bar, wherein the first tension spring is installed at one end on a first hook for elastic mounting at the carrier of the movement mechanism, and at the other end is installed on a second hook for elastic mounting at the lifting bar, wherein the two hooks are arranged at a distance, one above the other, and are drawn toward one another.

11. An apparatus as claimed in claim 1 wherein said printer comprises a sealable flap under which said single 1-inch ink jet print head is installed, and wherein said opening is situated in a lower housing shell of said apparatus housing, so as to be accessible via said opening by unsealing said flap.

12. An apparatus as claimed in claim 1 comprising a tension spring that exerts a spring force on said print carriage, said tension spring being mounted on one end of a hook-shaped spring mount of a lateral projection of said print carriage, and said spring mount having an opposite end mounted on a hook-shaped spring mount in an opening in a middle of a bearing plate, so that said print carriage is pulsed downwardly to a stop at which a support contour of said print carriage rests on a running surface of a lifting bar.

13. An apparatus as claimed in claim 1 wherein said apparatus housing comprises a lower housing shell in which said opening is provided, and has an additional opening via which said manual displacement train is accessible with a tool in order to operate said manual displacement train with said tool.

* * * * *